US005884808A

United States Patent [19]

Muderlak et al.

[11] Patent Number: 5,884,808

[45] Date of Patent: Mar. 23, 1999

[54] MATERIAL DISPENSING METHOD AND APPARATUS HAVING DISPLAY FEATURE

[75] Inventors: Kenneth J. Muderlak, Shorewood, Wis.; Rocky Sheih, Hsin Chu, Taiwan

[73] Assignee: Technical Concepts, L.P., Mundelein, Ill.

[21] Appl. No.: 916,095

[22] Filed: Aug. 21, 1997

[51] Int. Cl.[6] ..... B67D 5/06

[52] U.S. Cl. ..... 222/23; 222/1; 222/25; 222/333; 222/649; 239/71; 239/74

[58] Field of Search ..... 222/23, 30, 25, 222/333, 1, 64, 66, 642, 646, 649; 239/70, 71, 74; 368/226, 217, 228, 242; 116/227, 264, DIG. 32

[56] References Cited

U.S. PATENT DOCUMENTS

| | | | |
|---|---|---|---|
| Re. 34,847 | 2/1995 | Muderlak et al. | 222/25 |
| 3,891,909 | 6/1975 | Newson | 318/469 |
| 4,063,664 | 12/1977 | Meetze | 222/70 |
| 4,099,704 | 7/1978 | Okumura et al. | 251/134 |
| 4,220,900 | 9/1980 | Mintz | 318/260 |
| 4,350,265 | 9/1982 | Giffiths et al. | 222/38 |
| 4,394,605 | 7/1983 | Terazawa | 318/280 |
| 4,455,012 | 6/1984 | Gupta | 251/134 |
| 4,544,893 | 10/1985 | Takahashi | 324/433 |
| 4,709,196 | 11/1987 | Mizuta | 318/282 |
| 4,795,883 | 1/1989 | Glucksman et al. | 219/272 |
| 4,830,791 | 5/1989 | Muderlak | 261/26 |
| 4,858,468 | 8/1989 | Tahara et al. | 73/149 |
| 5,046,655 | 9/1991 | Kor et al. | 239/71 |
| 5,064,120 | 11/1991 | Luttrell | 239/74 |
| 5,111,477 | 5/1992 | Muderlak | 392/390 |
| 5,130,659 | 7/1992 | Sloan | 324/435 |
| 5,249,718 | 10/1993 | Muderlak | 222/642 |
| 5,315,564 | 5/1994 | Upton | 367/140 |
| 5,406,188 | 4/1995 | Myslinski et al. | 320/14 |
| 5,449,117 | 9/1995 | Muderlak et al. | 239/6 |
| 5,488,276 | 1/1996 | Nishibe | 318/473 |

FOREIGN PATENT DOCUMENTS 0010391 4/1990 European Pat. Off. .

*Primary Examiner*—Andres Kadhnikow
*Assistant Examiner*—David Deal
*Attorney, Agent, or Firm*—Sonnenschein Nath & Rosenthal

[57] ABSTRACT

An apparatus for dispensing material from a container having a dispensing element includes a motor for repeatedly actuating the dispensing element to facilitate dispensing of the material from the container and a controller for activating the motor at predetermined time intervals. The controller may also control an LCD display to display the time remaining until the container is empty and optionally to display the battery life remaining.

8 Claims, 6 Drawing Sheets

400

Q1
E
B
C
R2
111
VCC
B1
B2
REG1
HT1015
C9
.1μf
C10
.1μf
C11
.10μf
VREF
B
C
E
R10
Q4
C14
0.1μf
VCC
E
Q2
B
C
406
M1
A
408
D1
C12
.01μf
1M
VREF
R4
414
LM393-1
R3
0.5
C13
.1μf
412
410
U2
R5
1.5k
402
VCC
R20
20k
504
R21
U3
LM393-2
506
900KΩ
502
R22

MATERIAL DISPENSING METHOD AND APPARATUS HAVING DISPLAY FEATURE

BACKGROUND OF THE INVENTION

The present invention relates generally to devices for repeatedly dispensing material and more specifically to an energy conserving dispensing device and method for dispensing material. In the past, various solid materials were utilized which sublimated, thereby dispersing a substitute odor for the odor found in public facilities. In order to enhance the dispersion of such sublimating materials, many suppliers developed powered fan devices which assisted in the dispersal of the sublimated material. Such devices are well known in the art. For example, the common assignee of the present invention owns U.S. Pat. No. 4,830,791 entitled Odor Control Device, issued May 16, 1989 which discloses a solid dispensing device. Also, odor control devices where a pressurized aerosol container is utilized are well known in the art. Aerosol-type dispensing devices typically include a battery powered motor that actuates the nozzle on the aerosol container on a periodic basis. Known devices have significant disadvantages. These devices do not inform the user of the amount of time or the number of days remaining until the container must be replaced or refilled. Additionally, such devices are not particularly energy efficient, and, if powered by batteries, require frequent servicing to replace the batteries.

It is also known to use liquid containers for dispensing odorizing liquid. Typically, a dispensing tube attached to the container directs a flow of liquid cleaning, disinfecting, or odorizing chemical (e.g. directly into a toilet bowl or the inside wall of a urinal). Such devices may also operate based on the flush action of a urinal or toilet and are referred to as in-line devices. One known device is a system for injecting metered amounts of chemicals into flush water as the flush water enters the toilet.

The above-described devices are usually battery powered to simplify installation. Because connection to a conventional AC outlet is not required for battery powered devices, installation is simplified and cost is reduced. When the batteries become depleted, the unit ceases to function. Accordingly, the batteries must be replaced periodically. Frequent replacement of the batteries is a significant disadvantage that becomes even more troublesome in devices that are not particularly energy efficient. Replacement of the batteries, if performed at unnecessarily frequent intervals, is an annoying task that increases maintenance costs and customer dissatisfaction. The problem of battery disposal also gives rise to environmental concerns. Customers are unwilling to perform frequent battery replacement and have been known to replace the entire device when battery replacement is required too frequently. Often, the device is replaced with an alternate model or a different manufacturer's device.

Another problem related to the energy efficiency of some of the above-described devices resides in the components used in the electronics of the devices. Some of the devices are constructed using LEDs (light emitting diodes) to provide warning signals to the user, such as an indication of a low-battery condition or a container empty condition. Other indications may also be provided. However, use of LEDs in these devices is part of the problem leading to frequent battery replacement. LED devices consume relatively large amounts of power, and use of several LEDs in a device can significantly reduce the life expectancy of the batteries. Again, this leads to unnecessary battery replacement and service calls. As more information is provided to the user, additional LEDs are required, resulting in further reduced battery life. Many known dispensing devices limit the information available to the user to reduce the number of LED devices. Often, only a low battery indication and a container empty indication are provided.

Use of LEDs in known dispensing devices renders display of relative remaining battery power difficult. Customers prefer devices having some means that indicate the useful remaining battery life so that a future service call to replace the batteries can be roughly estimated. Most known devices only include a single low-battery LED indicator, even though customers prefer that additional information be provided.

Accordingly, it is an object of the present invention to provide novel apparatus to substantially overcome the above-described problems.

It is another object of the present invention to provide a novel device for dispensing material that significantly reduces power consumption so that battery life is greatly increased.

It is still another object of the present invention to provide a novel device for dispensing material having a novel LCD (liquid crystal display) to significantly reduce the power drain on the batteries.

It is yet another object of the present invention to provide a novel device for dispensing material having a novel LCD display that provides an incremental display of remaining battery power and provides an indication of user-selected options.

It is another object of the present invention to provide a novel device for dispensing material having a novel LCD display that provides an indication of the number of days remaining until the container of material must be replaced.

It is a further object of the present invention to provide a novel device for dispensing material having very low power requirements such that the batteries operating the dispensing device rarely need to be replaced.

SUMMARY OF THE INVENTION

The disadvantages of present dispensing devices are substantially overcome with the present invention by providing a novel apparatus for dispensing material, such as odorizing, cleaning, or disinfecting material, having extremely low power consumption requirements. The novel dispensing device is particularly energy efficient resulting in a substantial increase in battery life. According to a specific embodiment of the present invention, battery power is conserved by utilizing a novel LCD display.

According to one aspect of the invention, a dispensing device includes a motor for repeatedly actuating the dispensing element to facilitate dispensing of the material from the container and at least one battery for providing electrical power to the motor. Also included is a controller for activating the motor at predetermined time intervals and an LCD display operatively coupled to the controller where the LCD display is configured to provide at least an indication of time remaining until the container is empty. The LCD display includes a multi-segment display such that each segment of the LCD display, when activated, indicates that a predetermined percentage of battery life remains.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1A:
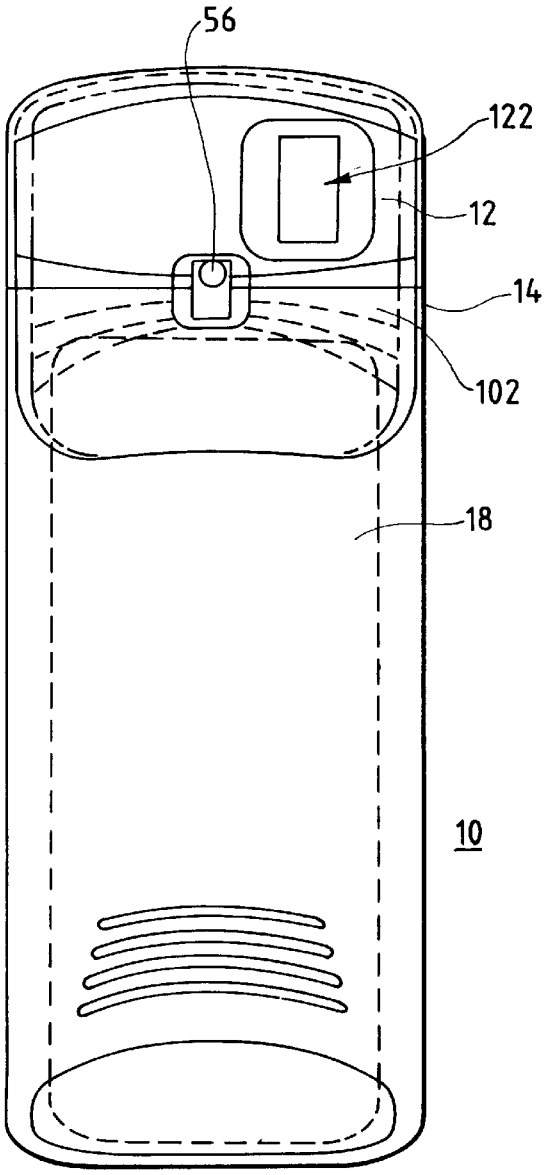
FIG. 1A is a front elevational view of a specific embodiment of a dispensing apparatus, according to the present invention.
Figure 1B:
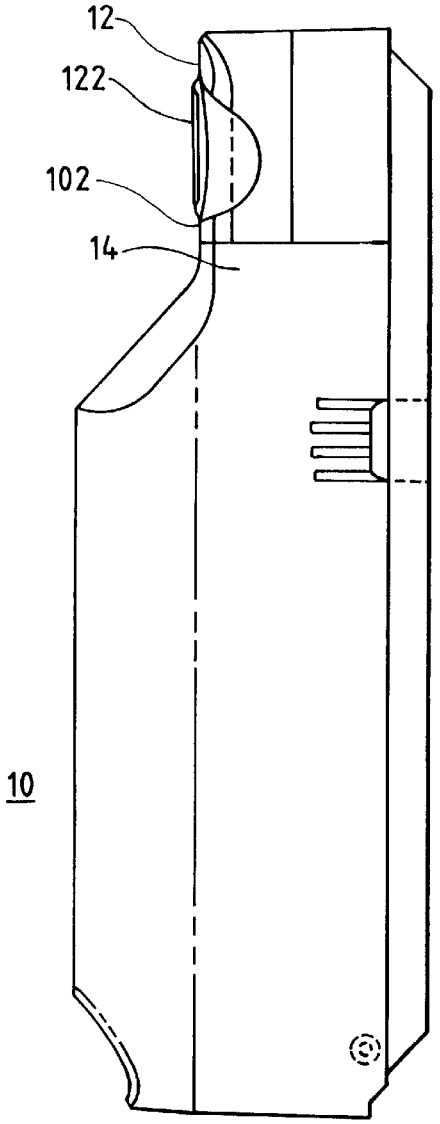
FIG. 1B is a side elevational view of the dispensing apparatus shown in FIG. 1A.

Referring now to FIG. 1A and FIG. 1B, the dispensing device 10 is generally shown. The dispensing device 10 includes a front panel 12 attached to an enclosure 14, or formed integrally with the enclosure. The enclosure 14 may be formed from plastic or other suitable material. A container 18, shown in phantom in FIG. 1A, is housed within the enclosure 14 and in one embodiment may contain an odorizing, cleaning, or disinfecting chemical. The container 18 may be a pressurized aerosol type container where depression of a nozzle 56 attached to the container 18 causes a predetermined amount of chemical to be dispensed. However, the container 18 may also be a liquid pump type container or any other container where depression of the nozzle 56 dispenses material. The nozzle 56 is actuated by a hammer and cam mechanism (not shown) which is coupled to a motor (not shown) through a gearing mechanism (not shown). The hammer and cam mechanism, the motor, the gearing mechanism, and the mechanics of the dispensing device 10 generally, are described in U.S. Pat. No. 5,038,972 issued on Aug. 13, 1991, entitled Metered Aerosol Fragrance Dispensing Mechanism, reissued on Feb. 7, 1995 as Re. 34,847, both of which are owned by the common assignee of this patent/patent application and are hereby incorporated by reference herein.

Figure 2:
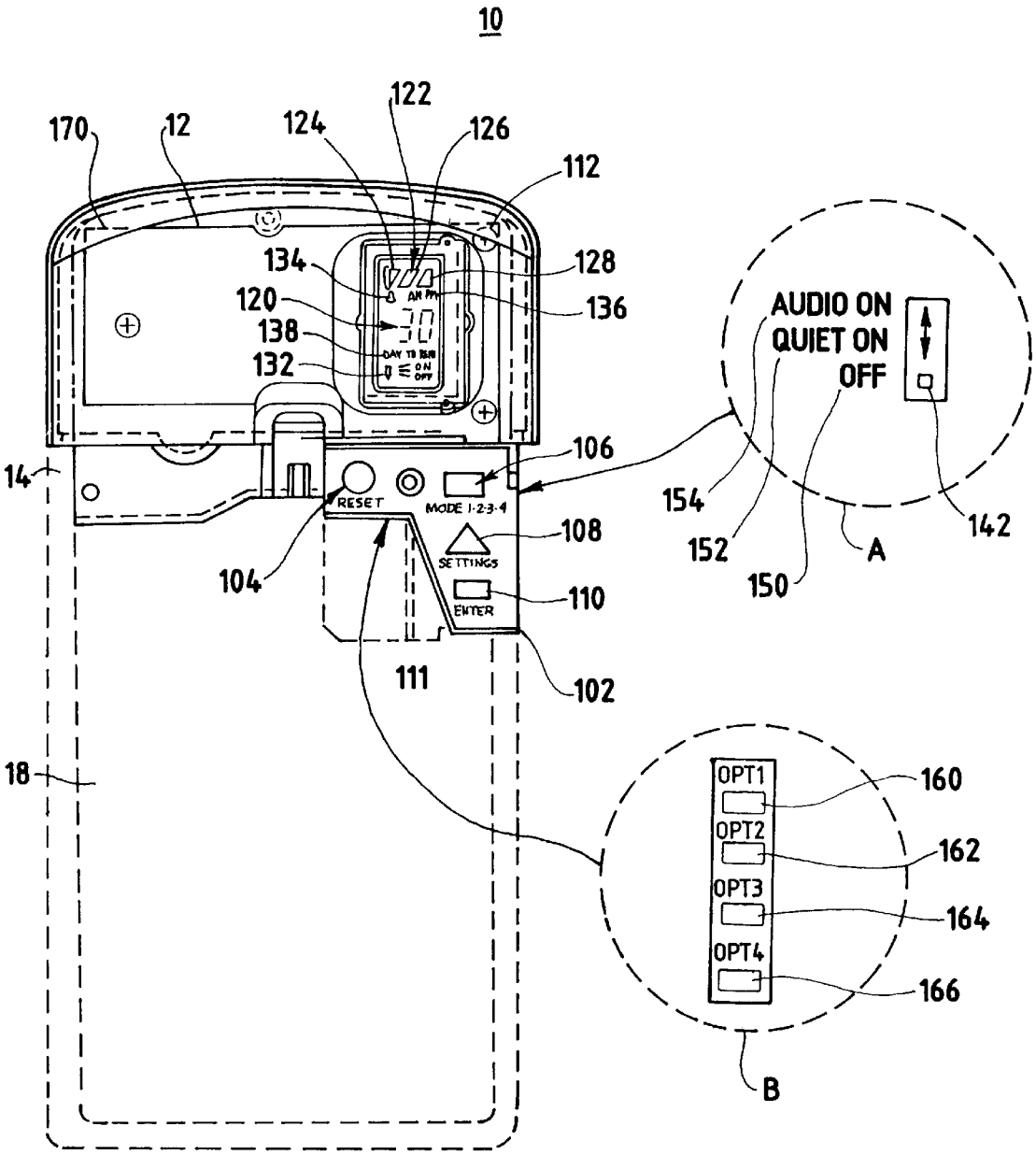
FIG. 2 is a pictorial representation of a portion of a front panel of one embodiment of the dispensing device shown in FIG. 1A, particularly illustrating control switches and an LCD display.

Referring now to FIG. 2, one embodiment of the invention is shown in which a control panel 102 is mounted on the front panel 12 or may be integrally formed with the front panel 12. The control panel 102 includes a reset switch 104, a mode switch 106, a "settings" or "adjust" switch 108, an enter switch 110, a manual on/off rocker-type switch 111, and a liquid crystal display (LCD display) 112 having several separate LCD portions. The reset switch 104, the mode switch 106, the settings switch 108, and the enter switch 110 are all pushbutton type momentary contact switches in the illustrated embodiment and may provide multiple functions when depressed multiple times in succession, as will be described in greater detail hereinafter. Of course, the switches described above may be any type of suitable button or switch known in the art.

Figure 3:
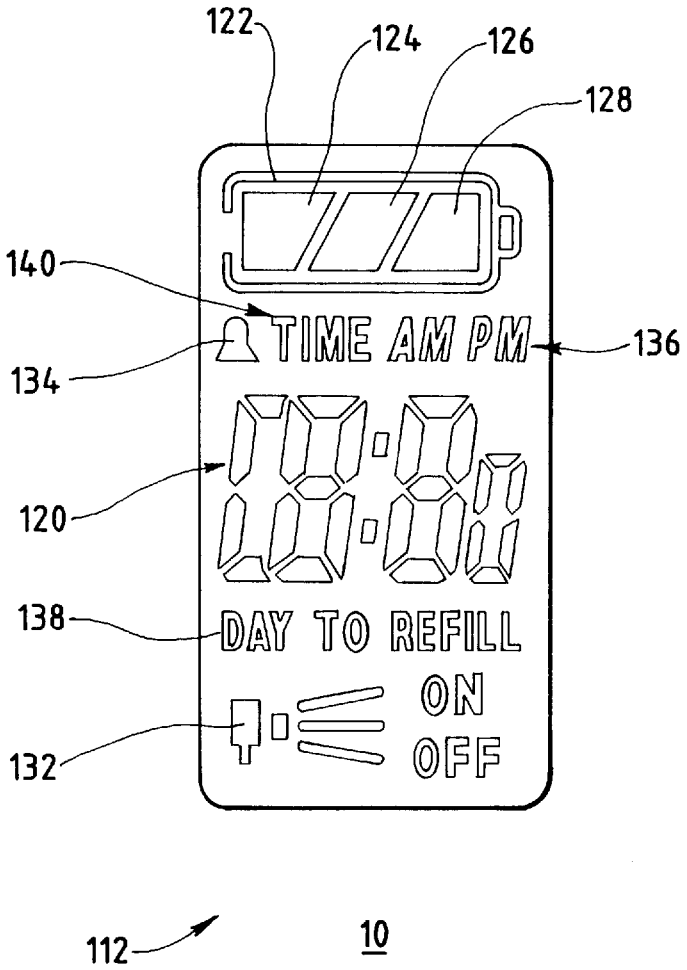
FIG. 3 is an enlarged view of the LCD display shown in FIG. 2.

Referring now to FIGS. 2 and 3, FIG. 3 illustrates a specific embodiment of the LCD display 112 in greater detail. The LCD display 112 is preferably a three by thirty-four segment LCD having a numerical display 120 and other graphical icons, as will be described hereinafter. The LCD display 112 includes a three segment LCD graphical display 122 that appears in the shape of a battery having three separate portions formed by a first segment 124, a second segment 126, and a third segment 128. The three segment graphical display 122 provides the user with an indication of remaining battery power. The LCD display 112 further includes graphical icons, such as a SPRAY (PUMP) on/off indicator 132 that indicates whether spray (pump) adjustments are currently being accessed, a tone icon 134 indicating that generation of audible tones or other audio indicators is enabled, an AM/PM indicator 136, a "DAYS TO REFILL" indicator 138, and a TIME indicator 140 for setting time (FIG. 3). The DAYS TO REFILL indicator 138, when enabled, indicates that the number represented by the numerical display 120 is the number of days left until the container 18 (FIG. 1) must be refilled or replaced.

A three-position slide switch 142 (FIG. 2) is provided under the control panel 102. The slide switch 142 is labeled as "A" in FIG. 2. The slide switch 142 controls the generation of tones, depending whether the switch is in an OFF position 150, a QUIET-ON position 152, or an AUDIO-ON position 154, as will be described in greater detail hereinafter.

A number of jumpers are provided on a printed circuit board (not shown) within the device for configuration of the product during manufacture, and are not intended to be accessed by the user. These jumpers may be removable or cuttable jumpers, or simply traces on the printed circuit board that can be abraded, severed, or cut as required. These jumpers, designated option 160, option 162, option 164, and option 166, are shown labeled as "B" in FIG. 2. Briefly, option 160 selects between a 0.7 second and a 0.9 second motor activation time, option 162 selects between a 0.1 second delay or no time delay for motor actuation, option 164 selects between a 3000 and a 6000 actuation cycle, and option 166 selects between an end-stop condition and a non-stop mode after a refill count has been reached. The function of the option switches or jumpers 160, 162, 164, and 166 will be described in greater detail hereinafter with reference to FIG. 4.

In operation, the dispensing device 10 of the illustrated embodiment functions as follows. Upon initial activation by turning on the device via on/off switch 170, or after the batteries have been installed or replaced, the reset switch 104 is briefly depressed. The reset switch 104 is a pushbutton type switch that cause the electronics of the dispensing device 10 to be reset. The reset switch 104 is also briefly depressed when the container 18 is replaced to permit recalculation of the time remaining until refill, as will be described hereinafter. If the reset switch 104 is depressed and held for four seconds, the dispensing device 10 enters a special demonstration mode adapted to function as a sales tool. In this mode, the special features of the dispensing device 10 are rapidly demonstrated, such as how changes in remaining battery power are displayed, how the days to refill is affected by various mode options, and the like. For example, to begin the demonstration all segments 124, 126, and 128 of the three segment graphical display 122 are activated and flash on and off at one-half second intervals. The demonstration then progresses where each of the three segments 124, 126, and 128 are turned off progressively after one second to indicate that the remaining battery power has decreased from 100% power, to 66.7% power, to 33.3% power, an so on. These battery power levels, of course, are approximations. To simulate a drop in battery power below 33.3%, all three segments 124, 126, and 128 are simultaneously flashed at a one-half second duty cycle, followed by an audio signal if activated.

Another feature illustrated in the demonstration mode is the display of the number of days until a refill of the container 18 is required. This is indicated using the DAYS TO REFILL indication 138 in conjunction with the numerical display 120. For example, the numerical display 120 may count down from 30 days to zero days at one second increments. When zero days has been reached, indicating that the container 18 must be refilled, the numerical display 120 flashes "00" on and off at one-half second intervals while a tone is emitted if the tone option is selected. In the demonstration, the days may count down at a rate of about one day per second to provide the user with a general impression of the operation of the dispensing device 10. Exiting the demonstration mode is a simple matter of quickly depressing the reset button. This action returns the settings to factory default values.

In normal operation, that is, a non-demonstration mode, the mode switch 106, the settings switch 108, and the enter switch 110 control the function of the dispensing device 10. A first depression of the mode switch 106 causes the dispensing device 10 to enter mode 1, a second depression of the mode switch causes the dispensing device to enter mode 2, a third depression of the mode switch causes the dispensing device to enter mode 3, and a fourth depression of the mode switch causes the dispensing device to enter mode 4. While in each mode, depression of the settings switch 108 modifies the particular option(s) available in that mode. Depression of the enter switch 110 selects and programs the available option presented to the user. If within a particular mode, an option is not entered within, for example, two minutes, mode 1 is automatically entered as a default mode and a particular mode option is automatically selected. Preferably, a short tone of about 0.5 seconds in length accompanies the user's depression of the mode switch 106 to provide user feedback. The short tone is also produced when the two minute time period elapses and mode 1 is entered by default.

Mode 1 determines the frequency with which the dispensing device 10 causes material in the container 18 to be dispensed. High, medium, and low dispensing levels are available where the medium level is defined to be the default value or factory programmed value. When the dispensing device 10 is programmed by the user to operate in the high dispensing level in the illustrated embodiment, material (fragrance) is preferably dispensed about every seven and one-half minutes (7 minutes and 48 seconds exactly). At the high dispensing level of mode 1, a maximum amount of material is dispensed and the time between refilling the container 18 is at a minimum. Accordingly, at the high dispensing level, the container will be depleted more quickly than at the medium and low dispensing levels.

When the dispensing device 10 is programmed to operate in the medium dispensing level of mode 1, material is preferably dispensed about every 15 minutes (14 minutes and 24 seconds exactly). This is calculated to provide 3000 dispensing cycles in a thirty day period, or about 100 dispensing cycles per day. Of course, other dispensing cycles may also yield acceptable results.

Finally, when the dispensing device 10 is programmed to operate in the low dispensing level of mode 1, material is preferably dispensed about every 30 minutes (28 minutes and 48 seconds exactly). At the low dispensing level of mode 1, a minimum amount of material is dispensed and the time between refilling the container 18 is at a maximum. The high, medium, and low dispensing levels of mode 1 are displayed to the user on the numerical display 120 and are sequentially displayed when the user depresses the settings switch 108. The dispensing level is identified by displaying the symbols "HI," "ME," and "LO", respectively on the numerical display 120. The dispensing level is then selected or programmed by depression of the enter switch 110 (the number of days to refill is displayed). After the dispensing level in mode 1 has been selected, mode 2 is automatically entered and the user may make further choices.

In mode 2, the actual time of day is entered. The settings switch 108 is used to increase the time displayed on the numerical display 120 in conjunction with the AM/PM indicator 136. When the correct time is displayed, the user depresses the enter switch 110 to program the dispensing device 10 with the correct time of day. Preferably, the time of day is advanced by ten minute increments each time the settings switch 108 is depressed, but other increments may also be workable in this mode. After the correct time of day in mode 2 has been entered, mode 3 is automatically entered and the user may make further choices.

Mode 3 permits the user to select a "twelve hour on/off" option or a "twenty-four hour" option. In the illustrated embodiment, if the twelve hour on/off option is selected, the dispensing device 10 will only dispense material for a selected period of twelve hours during each twenty four hour period. This is essentially a "day-time/night-time" option where the dispensing device 10 is programmed to dispense material only, for example, during the day or night, respectively, but is governed solely by the time rather than the amount of light present. This option is typically selected to program fragrance "on" during the period when workers are present. Of course, this could occur during the day or at night, but workers are typically present during the day time. The twelve hour on/off option is identified by displaying the number "12" on the numerical display 120. The user then depresses the enter switch 110 to select this option. In the illustrated embodiment, if the twelve hour on/off option is selected, the start time for dispensing must be additionally selected. The user then enters the time at which to begin the twelve hour dispensing period. For example, the user may enter 7:00 pm to begin the twelve hour cycle. However, any time may be entered. Selection of the 12 hour on/off option in mode 3 essentially doubles the time between refilling the container 18 relative to the twenty-four hour option. Other duty cycles could also be used.

If the twenty-four hour option is selected, the dispensing device 10 dispenses material throughout the entire twenty-four period according to the high/medium/low option selected in mode 1. The twenty-four option is identified by displaying the number "24" on the numerical display 120. The twenty-four hour option represents the default condition. After the twelve hour or twenty-four hour option of mode 3 has been entered by the user, mode 4 is automatically entered and the user may make further choices.

In mode 4 of the illustrated embodiment, zero, one, or two days may be "skipped" each week so that dispensing is inhibited during selected days. This is essentially a "weekend" option where the user would typically inhibit dispensing during the weekend. However, any one or two days of the week may be selected. When no days (zero days) are designated to be skipped, the option is referred to as the seven day option because the dispensing device 10 operates seven days per week. When one day is designated to be skipped, the option is referred to as the six day option. Similarly, when two days are designated to be skipped, the option is referred to as the five day option. While in mode 4, the user depresses the settings switch 108 to select the seven day, the six day, or the five day option and then depresses the enter switch 110 to program that option. If the six day or five day option is selected, the user must then select the particular day(s) of the week during which dispensing is inhibited. The day(s) of the week to be skipped are displayed on the numerical display 120 as "MO, TU, WE, TH, FR, SA, and SU," respectively. The day(s) selected to be skipped is then selected by depressing the enter switch 110. The seven day option where no dispensing is inhibited represents the default condition.

In practice, the user selects the seven day option simply by not selecting a day to be skipped. The six day option is activated by the user's selection of a single day to be skipped, and the five day option is activated by the user's selection of a second day to be skipped.

The user may also review all of the selected options by depressing the mode switch 106 repeatedly without making selections. Selected options will not be changed unless the user depresses the settings switch 108 to change the option and subsequently depresses the enter switch 110 to program the selected option. As mentioned previously, if the user fails to depress the enter switch 110, after a delay of about two minutes the displayed selection is automatically programmed. Accordingly, the user may review all of the selected options previously entered or may review the default settings currently programmed. Optionally, a short tone of about 0.5 seconds in length accompanies the user's depression of the enter switch 110 to provide user feedback that the selected option has been programmed.

The high/medium/low options of mode 1, the twelve hour/twenty-four option of mode 3, and the seven day/six day/five day option of mode 4 provide many different levels or frequencies of dispensing and hence, significantly affects the time between which refills of the container 18 are required. The indication of the days remaining to refill the container 18 is displayed on the numerical display 120 and represents a significant feature of the dispensing device 10. Table 1, immediately below, provides an indication of the various possibilities for days remaining to refill the container 18 when the various options of mode 1, mode 3, and mode 4 are selected. Of course, dispensing frequencies other than those provided in the preferred embodiment may also be satisfactory.

TABLE 1

| | DAYS REMAINING UNTIL REFILL | | |
|---|---|---|---|
| | HIGH | MEDIUM | LOW |
| 24 hour and 7 days | 15 | 30 | 60 |
| 12 hour and 7 days | 30 | 60 | 120 |
| 24 hour and 6 days | 17.5 | 35 | 70 |
| 12 hour and 6 days | 35 | 70 | 140 |
| 24 hour and 5 days | 21 | 42 | 84 |
| 12 hour and 5 days | 42 | 84 | 168 |

Thus, it can be seen that the number of days between refills may vary from a low of fifteen days, when the dispensing device 10 operates seven days per week (mode 4), twenty four hours per day (mode 3) at a high dispensing level (mode 1), to one-hundred and sixty-eight days, when the dispensing device operates five days per week (mode 4), twelve hours per day (mode 1) at a low dispensing level (mode 1). As noted above, the twenty-four hour/seven day/medium dispensing level represents the default condition. In the default mode, the container 18 must be refilled or changed every thirty days, as illustrated in Table 1 above.

Known dispensing devices do not provide the user with an indication of the number of days remaining until a refill is required. Typically, known devices simply inform the user when the container is empty. Providing an indication of the number of days until a refill is required is a significant feature and permits the user to timely schedule maintenance of the dispensing device 10 rather than estimating when the container 18 will need replacement or waiting until the container is empty. Timely scheduling of service calls is cost-effective and reduces labor costs associated with servicing the dispensing device 10. Such timely scheduling also insures uninterrupted operation. For example, if the LCD display 112 indicates that fourteen days remain until a refill is necessary, a service call may be scheduled two weeks in advance to insure timely servicing and uninterrupted operation of the dispensing device 10. This results in increased convenience for both on-site service and off-site service contractors.

Further, the indication of the number of days remaining is recalculated every time that the mode options are changed or when the container 18 is replaced and reset is pressed. For example, if the twenty-four hour/seven day/medium dispensing options are selected, then initially, the numerical display 120 would indicate that thirty days remain until a refill is required, as is illustrated above in Table 81. Further, assume that half-way through the month, for example at fifteen days, the user changes the options and selects the five day/twelve hour/low dispensing option. The new user selected options would permit 168 days between refills, assuming that the container 18 was full. However, in this example, the container is only one-half full because the dispensing device 10 had already been operating for fifteen days of the original thirty days. Accordingly, the dispensing device recalculates the remaining time and displays the number "84" on the numerical display 120, rather than the number "168," to indicate that eighty-four days remain until a refill is needed. This represents one-half of the original one-hundred and sixty-eight days associated with the new user selected option. Recalculation and display of an updated number of days remaining occurs any time that any option is changed which affects the rate of dispensing. Thus, the user is always informed of the number of days remaining until a refill is required, regardless of changes in the dispensing rate.

Note that the above-described LCD display 112 and the operation of the control panel 102 with its various modes and options is not limited to a dispensing device 10 using only a pressurized aerosol container 18. The dispensing device 10 may include, for example, a liquid pump container, a liquid drip container, or other suitable container. Further, the dispensing device may be adapted to dispense solid material where the dispensing device tracks the amount of material remaining and informs the user as to the number of days remaining until the material must be replenished.

Figure 4A:
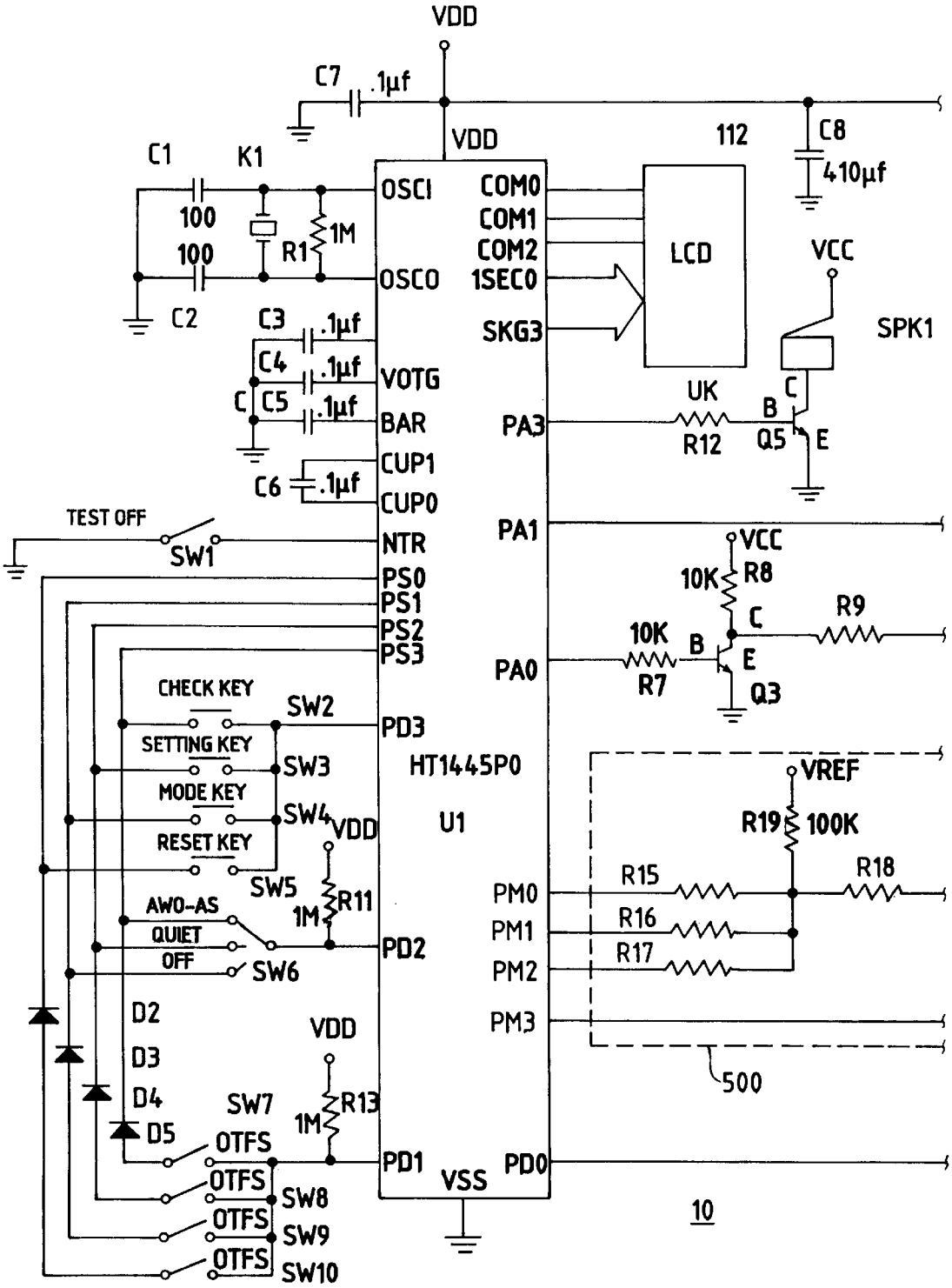
FIG. 4 is a schematic circuit diagram of a specific embodiment of control circuitry for the dispensing device of FIG. 1A.
Figure 4B:
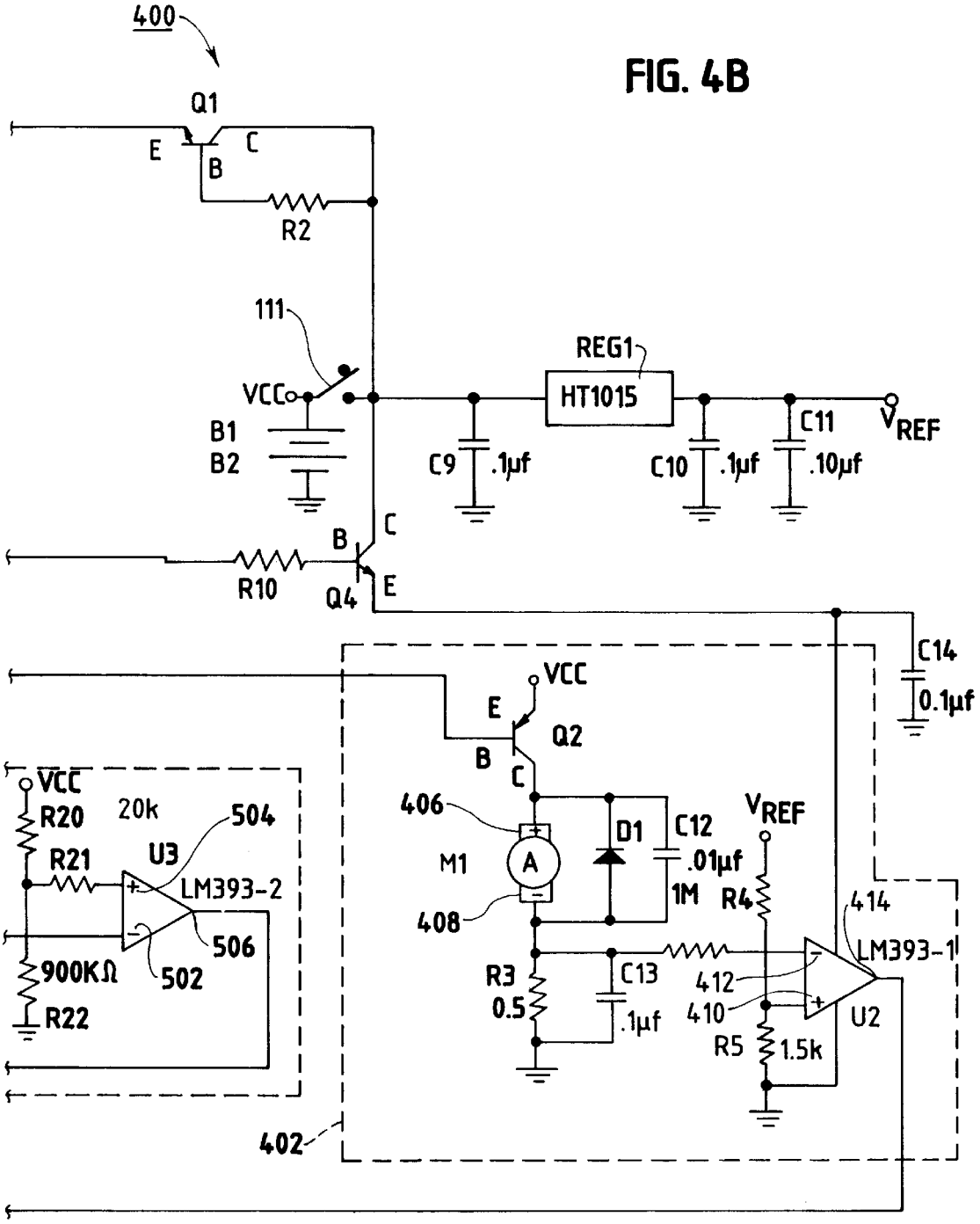

Referring now to FIG. 4, there is shown a schematic diagram for a specific embodiment of electronic circuitry for the illustrated embodiment of the dispensing device 10 (FIG. 1). Table 2 provides examples of component designations, component definition, and typical values or types, where applicable for a specific embodiment of the circuit of FIG. 4. Table 3 provides information about a specific microprocessor U1 for one embodiment for the circuit of FIG. 4 and includes a definition of the pad number, the pad name, input/output definition, mask option, and function of the microprocessor pin.

TABLE 2

| DESIGNATION | COMPONENT | VALUE/TYPE |
|---|---|---|
| B1, B2 | Battery | 1.5 volt |
| C1 | Capacitor | 100 pF |
| C2 | Capacitor | 100 pF |
| C3–C5 | Capacitor | 0.1 uF |
| C6 | Capacitor | 0.1 uF |
| C7 | Capacitor | 0.1 uF |
| C8 | Capacitor | 470 uF |
| C9–C10 | Capacitor | 0.1 uF |
| C11 | Capacitor | 10 uF |
| C12 | Capacitor | 0.01 uF |
| C13 | Capacitor | 0.1 uF |
| C14 | Capacitor | 0.1 uF |
| D1 | Diode | 1N4148 or Equiv. |
| D2–D5 | Diode | 1N4148 or Equiv. |
| LCD | LCD 3 × 11 segment display | 3 × 11 segment |
| M1 | Motor | KF-510-18315 |
| Q1 | Transistor - NPN | 2SC945 or Equiv. |
| Q2 | Transistor - PNP | 2S3562 or Equiv. |
| Q3 | Transistor - NPN | 2SC945 or Equiv. |
| Q4 | Transistor - NPN | 2SC945 or Equiv. |
| Q5 | Transistor - NPN | 2SC945 or Equiv. |
| R1 | Resistor | 100 MΩ |
| R2 | Resistor | 1 KΩ |
| R3 | Resistor | 0.5 Ω |
| R4 | Resistor | 473 KΩ |
| R5 | Resistor | 15 KΩ |
| R6 | Resistor | 220 KΩ |
| R7 | Resistor | 10 KΩ |
| R8 | Resistor | 10 KΩ |
| R9 | Resistor | 75 Ω |
| R10 | Resistor | 13 KΩ |
| R11 | Resistor | 1 MΩ |
| R12 | Resistor | 1 KΩ |
| R13 | Resistor | 1 MΩ |
| R15 | Resistor | 105 KΩ |
| R16 | | 80.6 KΩ |
| R17 | | 63.4 KΩ |
| R18 | Resistor | 220 KΩ |
| R19 | Resistor | 10 KΩ |
| R20 | Resistor | 10 KΩ |
| R21 | Resistor | 530 KΩ |
| R22 | Resistor | 500 KΩ |
| REG1 | Voltage Regulator | HT1015 |
| SW1–SW5 | Momentary contact switch | Momentary contact switch |
| SW6 | Three position slide switch | DP3T |
| SW7–SW10 | Slide switch | SPST |
| U1 | Microprocessor | HT445P0 |
| U2–U3 | Operational amplifier | LM393 |
| X1 | Crystal | 32, 760 kHz |

TABLE 3

MICROPROCESSOR U1

| Pad No. | Pad Name | I/O | Mask Option | Function |
|---|---|---|---|---|
| 1, 34–65 | SEG33-SEG03 | O | — | LCD driver outputs for LCD segments |
| 2–5 6–9 10–13 | PS0–PS3 PD3–PD0 PM0–PM3 | I/O | CMOS, PMOS, NMOS, Wake-up Pull-high, Pull-low latch or none | 4-bit input/output port with tri-state register |
| 14 | RES/ | I | — | Input to reset an internal LSI Reset is active on a low level with an internal pull-high resistor |
| 15 | TEST/ | I | — | For test mode only the TEST pin should be left open for normal operation |
| 16 | INT/ | I | — | Input (with a pull-high resistor) for an external interrupt. Activated on a high to low edge trigger transition |
| 17 | $V_{SS}$ | I | — | Negative power supply, GND |
| 18 | TMCLK | I | Internal frequency source and pull-high or none | Input for TIMER clock. TIMER can be clocked by an external clock or internal frequency source. |
| 19–22 | PA0–PA3 | O | CMOS OR PMOS open drain | 4-bit output port PA3 for a carrier output, or 4-bit output ports PA1 and PA0 for PFD output. |
| 26 | BAR | I | — | Voltage divider capacitor |
| 27 | $V_{DD}$ | I | — | Positive power supply |
| 28 29 | OSCI OSCO | I O | Crystal or RC | OSCI and OSCO are connected to a resistor (RC) or a crystal for an internal system clock. |
| 30–32 | COM0–COM2 | O | ½ or ⅓ commons duty | Outputs for LCD |
| 25 | VOTG | I | — | Voltage doubler capacitor |
| 33, 34 | CUP0, CUP1 | | | |

The schematic diagram of FIG. 4 in conjunction with Table 2 and Table 3 illustrate a circuit 400 that controls all of the functions of the dispensing device 10. The microprocessor U1 performs all control and display functions and operates the dispensing device 10 according to preprogrammed instructions. The microprocessor U1 may be, for example, a four-bit microcomputer model HT445P0 provided by Holtek, Inc. However, any suitable microcomputer or controller capable of controlling LCDs (liquid crystal display) and having input and output port capability may be used.

The microprocessor U1 includes a crystal X1 coupled between pads OSCI and OSCO. A resistor R1 is connected in parallel across the crystal X1 while capacitors C1 and C2 respectively, are coupled between each end of the crystal and ground. The crystal X1 may be, for example, a 32,760 kHz quartz crystal from which the microprocessor U1 derives its timing signals and clock signals.

Pads RES/, VOTG, and BAR are coupled to capacitors C3, C4, and C5, respectively, to ground. A capacitor C6 is also connected between pads CUP1 and CUP2 and functions as a voltage doubler capacitor, as is required for proper operation of the microprocessor U1. The circuit 400 receives electrical power from two 1.5 volt batteries B1 and B2. Electrical power supplied directly by the batteries B1 and B2 is labeled Vcc. The switch 111 selectively connects the batteries B1 and B2 to the circuit 400. The microprocessor U1 receives power on pad VDD which is coupled to the batteries B1 and B2 through transistor Q1. A resistor R2 is connected across the base and collector of the transistor Q1 to bias the transistor to conduct, thereby supplying the battery voltage Vcc, minus a small voltage drop, to pad VDD. A noise filtering capacitor C7 and a battery backup capacitor C8 are also coupled between pad VDD of the microprocessor U1 and ground. The transistor Q1 and the capacitor C8 form a battery backup circuit such that when the batteries B1 and B2 are temporarily removed, the capacitor C8 continues to supply power to the microprocessor U1 for approximately ten minutes. Accordingly, all of the user selected options and default settings are retained when the batteries are replaced. When the batteries B1 and B2 are removed, the transistor Q1 is turned off preventing reverse current flow from the capacitor C8 to the other components of the circuit 400. This permits the microprocessor U1 to preserve the state of all of its internal memory and registers for a period of at least ten minutes. Thus, the customer is not inconvenienced when the batteries B1 and B2 are replaced since the microprocessor U1 "remembers" important data, such as the amount of odorizing chemical remaining in the container 18 (FIG. 1) and the number of day remaining until the container must be replaced.

The battery voltage Vcc is further connected to a voltage regulator device REG1 which provides a regulated voltage output labeled Vref. A noise filtering capacitor C9 is coupled between the input of voltage regulator REG1 and ground, while noise filtering capacitors C10 and C11 are coupled between the output of the voltage regulator REG1 and ground. The voltage regulator REG1 may be, for example, a Holtek, Inc. HT1015 voltage regulator which provides a fixed regulated output voltage. However, any suitable voltage regulator or zener diode may be used to provide a similar function.

A motor driver and stall detection circuit 402 is shown in dashed lines and includes a transistor Q2, a motor M1, a diode D1, capacitors C12 and C13, resistors R3, R4, R5, and R6, and a comparator U2. The comparator U2 may be, for example, one-half of an LM393 operational amplifier configured as a comparator. The motor M1 receives power from Vcc through the transistor Q2, which is switchably controlled by the microprocessor U1. An output bit PA0 of the microprocessor U1 is coupled to the base of a transistor Q3 via a resistor R7 while the collector of the transistor Q3 is coupled to Vcc through a pull-up resistor R8. The emitter of the transistor Q3 is connected to ground. The collector of the transistor Q3 is, in turn, coupled via a resistor R9 to the base of the transistor Q2. In operation, to activate the motor M1, the microprocessor U1, under software control, asserts a high level signal on the output bit PA0 causing the transistor Q3 to conduct. This forces the collector of the transistor Q3 to a low voltage level, which in turn, causes the transistor Q2 to conduct, thereby coupling the motor M1 between Vcc and ground, thus activating the motor. Of course, the motor M1 is supplied with the voltage level Vcc minus a small voltage drop caused by transistor Q2.

The comparator U2 also receives power Vcc through a switched transistor Q4 under S-microprocessor U1 control. An output bit PA1 of the microprocessor U1 is coupled to the base of the transistor Q4 via a resistor R10. The collector of the transistor Q4 is connected to Vcc while the emitter of the transistor Q4 is connected to the power pin of the comparator U2, and to a noise filtering capacitor C14. Thus, when the microprocessor U1 asserts a high level signal on the output bit PA1, the transistor Q4 conducts thereby supplying the voltage Vcc to the comparator U2. In this way, power to the comparator U2 can be disconnected during the time that the motor M1 is not activated to further conserve battery power. The comparator U2 function is only required during operation of the motor M1, as will be described in detail hereinafter. Accordingly, every effort is made to conserve battery power and to disconnect power from all components when not in use. Conservation of battery power is a significant feature of the novel device for dispensing odorizing material. Accordingly, all functions that use power have been selectively turned off when not in use. This includes disconnecting power from all components whose function is not currently needed, utilizing energy-efficient LCD displays, and minimizing power usage by the motor, as will be described hereinafter.

Referring now to the motor driver and stall detection circuit 402, the diode D1 and the capacitor C12 are connected in parallel across a positive terminal 406 and a negative terminal 408 of the motor M1. This reduces the back-EMF which may be generated when the motor is de-energized. The motor M1 is connected between the source of power Vcc via the collector of the transistor Q2.

The non-inverting input 410 of the comparator U2 is coupled to the junction of the resistors R4 and R5. The resistors R4 and R5 form a voltage divider network that determines a threshold voltage level for the comparator U2. Note that the voltage reference supplied to the voltage divider combination of the resistors R4 and R5 is connected to the voltage source Vref, not to the voltage source Vcc. This is done so that a precise reference voltage may be maintained regardless of the voltage level of the batteries B1 and B2, assuming that the voltage level of the batteries is above the minimum operating voltage input level of the voltage regulator REG1.

The inverting input 412 of the comparator U2 is the signal input and is coupled to the negative terminal 408 of the motor M1 through the resistor R6. The common junction between the negative terminal 408 of the motor M1 and the end of the resistor R6 is coupled to the parallel combination of the resistor R3 and the capacitor C13. The other end of the parallel combination of the resistor R3 and the capacitor C13 is connected to ground. The output 414 of the comparator U2 is coupled to an input bit PD0 of the microprocessor U1 so that the microprocessor can determine the state of the comparator.

In operation, the motor driver and stall detection circuit 402 functions as follows. When the motor M1 is energized, current flows through the windings of the motor to ground. Because the resistor R3 is connected between the motor and ground, the motor current also flows through the resistor R3. The flow of current through the resistor R3 causes a voltage drop across the resistor. This voltage drop is routed to the inverting input 412 of the comparator U2 as the signal input to the comparator U2. Thus, the current flowing through the motor M1 is converted to a voltage and compared to the reference threshold voltage present at the non-inverting input 410 of the comparator U2. When the voltage level present at the inverting input 412 is less than the reference voltage present at the non-inverting input 5410, the output 414 of the comparator U2 is at a high voltage (logic level one), indicating that the current passing through the motor M1 is lower than a maximum defined level. This indicates normal operation of the motor M1. Conversely, when the voltage level present at the inverting input 412 is greater than the reference voltage present at the non-inverting input 410, the output 414 of the comparator U2 is at a low voltage (logic level zero), indicating that the current through the motor M1 is greater than a maximum allowed level. This indicates a motor stall condition. Although the dispensing device includes circuitry that responds to a motor stall condition in a unique manner, the stall detection feature is not required for an appreciation or understanding of the inventive features claimed herein. Consequently, discussion of the stall detection feature will be limited for the sake of brevity.

As described above, a motor stall condition occurs when the nozzle 56 (FIG. 1) of the container 18 (FIG. 1), such as an aerosol container or liquid pump container, is in a fully depressed state while the motor M1 continues to be energized. Known dispensing devices are intentionally configured to cause a motor stall condition sustained for a short period of time to guarantee that the nozzle 56 of the container 18 will be depressed for a sufficient period of time, particularly when the batteries are at a low power level. However, in the present novel invention, no such energy consuming stall is needed because the proper amount of material is dispensed without sacrificing battery power by immediately detecting and eliminating a motor stall condition.

Figure 5:
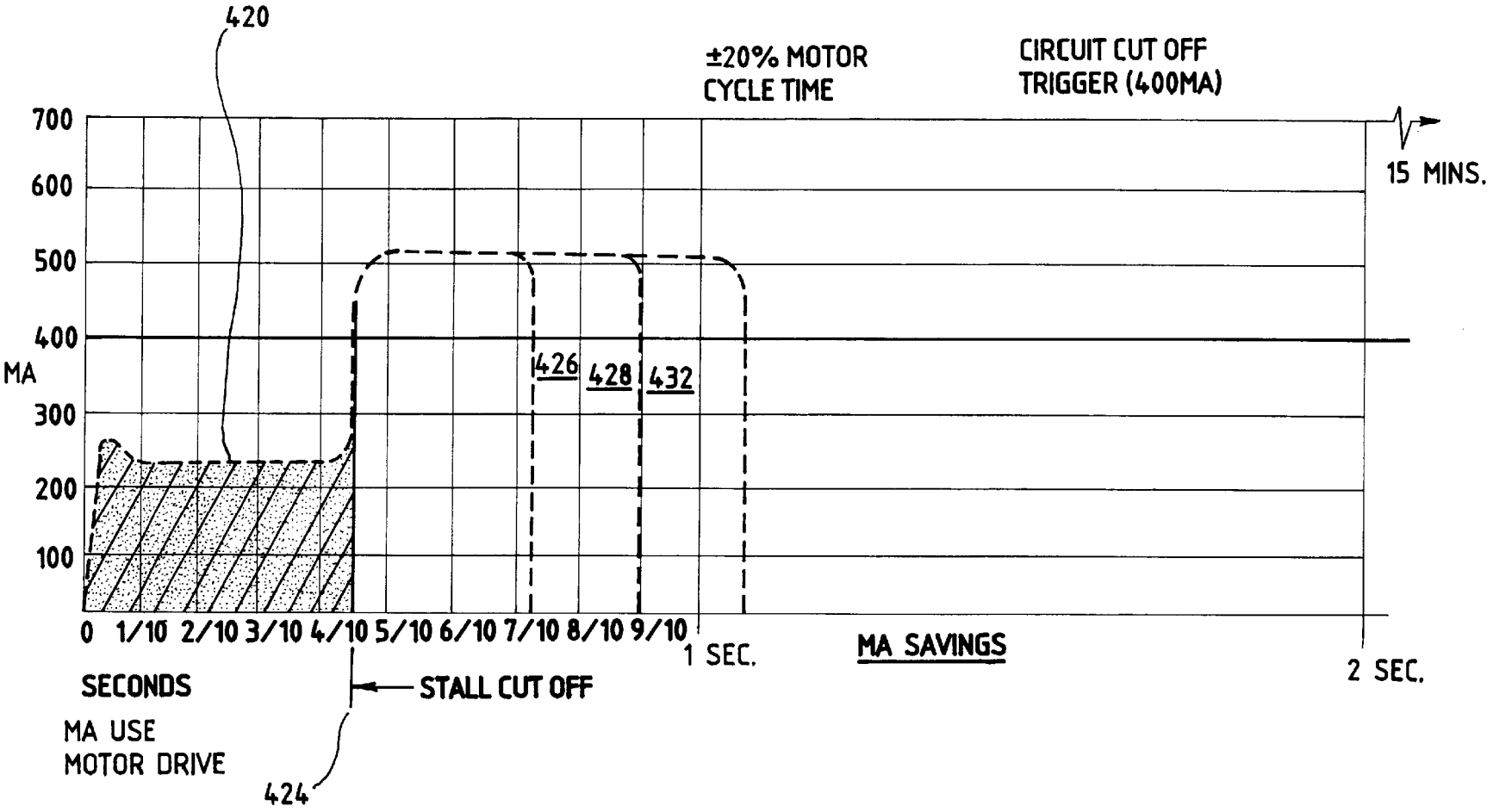
FIG. 5 is a graph depicting current consumption over time, particularly illustrating a motor stall condition.

Referring now to FIGS. 4 and 5, FIG. 5 graphically illustrates the motor stall condition according to a specific embodiment of the present invention. The motor stall condition causes a sharp increase in the current drawn by the motor M1 and appears in the form of a current "spike." As shown in FIG. 5, current is displayed in milliamperes on the "Y" axis while time is displayed in seconds on the "X" axis. The segment labeled 420 indicates usage of the motor M1 during normal operation or during a non-stall condition. The small increase in current shown by reference number 422 indicates current drawn during initial turn-on of the motor M1 and quickly comes to a steady state condition. In this specific example, by about 0.45 seconds into the cycle, a motor stall condition is entered, as indicated at segment 424. Once the motor stall condition is detected (by detection of the trigger threshold of 400 ma as illustrated), the motor M1 is immediately deactivated. Segments 426, 428 and 430 illustrate the current consumption of known devices that do not correct the motor stall condition, but rather, de-energize the motor M1 at approx. 0.7 seconds, 0.9 seconds and 1.0 second, respectively, based strictly on a predetermined period of motor-activation time.

Referring now to FIGS. 2 and 4, microprocessor pad INTR/ is coupled to a momentary contact switch SW1. Depression of the switch SW1 causes the microprocessor U1 to enter a test mode and perform internal tests to check the integrity of internal components, such as RAM and ROM, input/output ports, and various registers (not shown). Four momentary contact switches SW2, SW3, SW4, and SW5 are connected to the microprocessor U1 input bit PS3 and to the cathode of diodes D2, D3, D4, and D5, respectively. The cathode of the diodes D2, D3, D4, and D5 are further coupled to microprocessor input bits PS3, PS2, PS1, and PS0 respectively. The switches SW2, SW3, SW4, and SW5 directly correspond to the enter switch 110, the settings switch 108, the mode switch 106, and the reset switch 104, respectively, shown in FIG. 2.

Referring now to FIG. 4, a three position slidable switch SW6 is coupled to microprocessor input bit PD, which is further pulled up to voltage $V_{DD}$ via a resistor R11 to provide a user-selectable tone option. The switch SW6 directly corresponds to the slidable switch 14 shown in FIG. 2 and provides the audio options of AUDIO-ON 154, QUIET-ON 152, and OFF 154, as shown in FIG. 2. An audio tone output is provided by an audio element SPK1, which may, for example, be a miniature speaker or a piezo-electric transducer. The audio element SPK1 is driven by the collector of a transistor Q5 that is controlled by the microprocessor U1 output bit PA3 coupled to the base of the transistor Q5 via a current limiting resistor R12. Note that the tone icon 134 (FIGS. 2 and 3) is turned on only when the switch SW6 is set in the AUDIO-ON tone position to enable generation of the audible tone. When the switch SW6 is set in the OFF or the QUIET-ON position, the tone icon 134 is turned off.

Four toggle switches SW7–SW10 provide user options OPT1–OPT4, respectively. The four switches SW7–SW10 directly correspond to the switches or jumpers of FIG. 2 labeled option 160, option 162, option 164, and option 166. Each switch SW7–SW10 is coupled to an input bit PD1 of the microprocessor U1 and is pulled up to voltage $V_{DD}$ by a pull-up resistor R13. The other end of each switch SW7–SW10 is further coupled to the anode of the diodes D2, D3, D4, and D5, respectively. The switch SW7 controls selection of option OPT1. This permits the motor activation time to be either 0.7 or 0.9 seconds in duration. Variation of this parameter permits use of different gearing mechanisms associated with various models of the dispensing device 10, some of which may not implement the stall detection circuit. When the switch SW7 is open, a fixed motor activation time of 0.7 seconds is selected. When the 0.7 second duration option is selected, the motor stall detection circuitry is disabled. When the switch SW7 is closed, a fixed motor activation time of 0.9 seconds is selected.

As described briefly above, the options described are not normally selectable by a user. Option selection is made at the time of manufacture to satisfy particular product requirements.

The switch SW8 controls selection of option OPT2. This option is only selectable if the 0.9 second option of OPT1 has been selected. When the switch SW8 is open, a 0.1 second delay will elapse prior to declaring a motor stall condition. This option may be used because a small current spike occurs when the motor M1 is initially energized, as shown by reference numeral 422 of FIG. 5. To avoid erroneous detection of a motor stall condition when the "turn-on" spike occurs, the 0.1 second delay is introduced. When the switch SW8 is closed, no delay is introduced and the motor stall condition is immediately detected and reported when it occurs. The 0.1 second delay is also useful in insuring that pump compression in the pump-to-stall stroke is fully relieved.

The switch SW9 controls selection of option OPT3. When the switch SW9 is open, the dispensing device 10 indicates that the container 18 (FIG. 1) requires refilling after 3000 pump cycles. When the switch SW9 is closed, the dispensing device 10 indicates that the container 18 requires refilling after 6000 cycles or pump cycles. Selection of this option depends upon the volume of the container 18.

The switch SW10 controls selection of option OPT4. When the switch SW10 is open, the dispensing device 10 stops when the maximum count of number of cycles has been reached, depending whether 3,000 or 6,000 cycles has been set by option OPT3. The user may be informed that the container 18 (FIG. 1) requires replacement by audible and visual means, as will be described in greater detail hereinafter. When the switch SW10 is closed, the dispensing device 10 does not stop when the maximum count of number of cycles has been reached. Instead, a dispensing operation still occurs at the appropriate time, but the counter no longer counts dispensing cycles. This option is useful in situations where the bottle 18 may not be completely empty due to pumping tolerances and the degree to which the bottle was filled at installation.

Referring now to FIGS. 2–4, the LCD display 112 is driven by microprocessor pads COM0–COM2 and segment driver pads SEG03–SEG33. The LCD display 112 includes the numerical display 120 and the three segment graphical display 122 that appears in the shape of a battery. The numerical display 120, in the illustrated embodiment, indicates the number of days left before replacement of the container 18 is needed.

The LCD display 112 also provides the user with a variety of other indicators. The "ON" indicator means that the Mode option currently being selected or adjusted is on, while the "OFF" indicator means that the option currently being selected or adjusted is off. For example, in Mode 4, 24 hours on or off, if "ON" is selected the day displayed will be on, and if "OFF" is selected that particular day will be off.

The spray pictorial icon 132 shows that spray choices are open to selection with adjust, tone icon 134 indicates that generation of audible tones is enabled or disabled, and the AM/PM indicator 136 indicates the corresponding time of day. Note that the tone icon 134 is not activated when the switch SW6 is in the off position, indicating that production of tones is inhibited.

The three segment LCD display 122 indicates to the user the approximate percentage of remaining battery life. In the illustrated embodiment, when the batteries B1 and B2 are new and provide a voltage level Vcc of about 2.90 volts and above, all three of the segments 124, 126, and 128 are turned on to indicated that the battery power level is between 66.7% to 100% of full capacity. When the batteries B1 and B2 are at a power level between 33.3% and 66.7% of full capacity, the first segment 124 and the second segment 126 are turned on while the third segment 128 is turned off. This corresponds to a voltage level Vcc of about 2.82 to 2.90 volts. When the batteries B1 and B2 are at a power level between a low level and 33.3% of full capacity, only the first segment 122 is turned on while the second and third segments 124 and 126 are turned off. This corresponds to a voltage level Vcc of about 2.74 to 2.82 volts. Finally, when the batteries B1 and B2 are at a power level below the low power level, all of the segments 124, 126, and 128 flash. This corresponds to a voltage level Vcc below 2.74 volt. The LCD segments 124, 126, and 128 flash at about a 0.5 second duty cycle such that the segments are on for 0.5 seconds and then are off for 0.5 seconds. Along with the flashing indication, a tone of about 0.5 seconds in length is activated once every fourteen seconds, if the switch SW6 is in the AUDIO-ON position.

A battery test circuit 500 illustrated in FIG. 4 determines the power level of the batteries B1 and B2 in a manner that permits illumination of the LCD segments 124, 126, and 128 (FIG. 3) so that the user is informed of the remaining battery life. The battery test circuit 500 includes resistors R15, R16, and R17 connected to microprocessor output bits PM0, PM1, and PM2, respectively. The other end of the resistors R15, R16, and R17 are connected to the common junction of a resistor R18 and R19. The resistor R19, in turn, is pulled up to voltage level $V_{ref}$ so that a precise reference voltage level is supplied. The other end of the resistor R18 is routed to an inverting input 502 of a comparator U3, which may be, for example, the other half of the operational amplifier U2. A non-inverting input 504 of the comparator U3 is coupled to a voltage divider formed by resistors R20, R21, and R22. The resistor R20 is coupled to voltage Vcc to supply battery power to the signal input 504 (non-inverting input), while the resistor R22 is connected to ground. The common junction of the resistors R20 and R22 is, in turn, connected to the non-inverting input 504 through the resistor R21. The battery test circuit 500 functions in conjunction with the three segment LCD display 12 to provide an indication of the multiple ranges of remaining battery power.

The battery test circuit 500 functions as follows. Normally, each of the resistors R15, R16, and R17 are essentially disconnected from the microprocessor U1 by "tri-stating" the input bits PM0, PM1, and PM2. This conserves battery power because the battery test need not be performed on a continuous basis, but rather, is performed only on a periodic basis. Preferably, the battery test is performed about every 750 actuation cycles or about once per week in the default mode. Additionally, the test is only performed only when the motor M1 is not activated.

During the battery test, each input bit PM0, PM1, and PM2 is sequentially brought to a low logic level while the two other remaining input bits are left in the tri-state condition. When the selected input bit PM0, PM1, or PM2 is brought to a low voltage level, a voltage divider is formed by the selected resistor R15, R16, or R17 in conjunction with the resistor R19. Thus, three different selectable voltage divider networks are provided. Since the resistor R19 of the voltage divider networks is connected to $V_{ref}$, a precision voltage reference is supplied. Accordingly, a fixed and stable voltage level is routed to the inverting input 502 of the comparator U3 to provide a precise and selectable threshold level. This known threshold voltage level is compared against the voltage level provided to the non-inverting input 504, which represents the battery voltage Vcc. The value of each of the resistors R15, R16, and R17 is chosen so that the threshold voltage provided to the inverting input 502 represents the various power level ranges, such as low, 33.3%, and 66.7% of battery power capacity. Each of the resistors R15, R16, and R17 is sequentially brought low via the input bits PM0, PM1, and PM2, respectively, to provide three different threshold voltage values, which are then compared against the actual battery voltage Vcc supplied to the non-inverting input 504 of the comparator U3.

The output 506 of the comparator determines the relationship between the selected threshold voltage and the battery voltage, and provides either a high or low signal to an input bit PM3 of the microprocessor U1. In this way, the microprocessor determines for each range of voltage whether the battery power level is sufficient and turns on either one, two, or three segments 124, 126, 128 of the three segment display 122.

In an alternate embodiment, a solar cell and charging circuit is added to supply power to the battery to prolong the life of the battery. Accordingly, if sufficient light is supplied to the solar cell, the batteries may not need replacement.

When customers replace the batteries of a device, they may inadvertently use defective batteries or old batteries that have lost a portion of their power. One feature of the novel dispensing device 10 is that the consumer receives immediate feedback through the LCD display 122 as to the remaining power. As soon as the user installs replacement batteries and resets the device, the LCD display 122 immediately indicates the battery power level. Unlike some known devices which only present an indication of a low battery condition, the present invention informs the customer, via the LCD display 122, that the supposedly new batteries are only, for example, at 33.3% or 66.7% of maximum power. Thus, the customer can avoid using defective or worn batteries.

Specific embodiments of an apparatus for dispensing material according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. An apparatus for dispensing material from a container having a dispensing element, the apparatus comprising:

a motor for repeatedly actuating the dispensing element to facilitate dispensing of the material from the container;

at least one battery for providing electrical power to the motor;

a controller which activates the motor at time intervals; and a liquid crystal display operatively coupled to the controller, the liquid crystal display configured to provide at least an indication of remaining time until the container is empty.

2. The apparatus according to claim 1 wherein the liquid crystal display includes a multi-segment display such that each segment of the liquid crystal display, when activated, indicates to a user that a predetermined percentage of battery power remains.

3. The apparatus according to claim 1 wherein the controller progressively turns off adjacent segments of the liquid crystal display as the power remaining in the battery decreases from a full power condition to a low power condition.

4. The apparatus according to claim 1 further including a plurality of user activated switches operatively coupled to the controller, the plurality of switches providing user control over at least a rate that material in the container is dispensed.

5. The apparatus according to claim 4 having user selectable options including at least one of an option to select the length of a dispensing cycle, an option inhibiting dispensing on selected days, and an option inhibiting dispensing during selected hours in a day.

6. The apparatus according to claim 1 wherein the liquid crystal display includes indications representing whether at least a portion of the plurality of user-activated switches are in at least one of an open state and a closed state.

7. A method for dispensing material comprising the steps of:

a) activating an electric motor to actuate a dispensing cycle to dispense a desired amount of the material; and b) displaying an indication of time remaining until the material being dispensed is exhausted.

8. The method of claim 7 further comprising displaying an indication of a predetermined percentage of battery power remaining.

* * * * *